US006845592B2

(12) United States Patent
Voegele

(10) Patent No.: US 6,845,592 B2
(45) Date of Patent: Jan. 25, 2005

(54) PANEL CLIP ASSEMBLY FOR USE WITH SKYLIGHT OR ROOF PANELS

(75) Inventor: William P. Voegele, Pittsburgh, PA (US)

(73) Assignee: Extech Exterior Technologies, Inc., Pittsburgh, PA (US)

( * ) Notice: Subject to any disclaimer, the term of this patent is extended or adjusted under 35 U.S.C. 154(b) by 0 days.

(21) Appl. No.: 10/117,419

(22) Filed: Apr. 5, 2002

(65) Prior Publication Data

US 2003/0188500 A1 Oct. 9, 2003

(51) Int. Cl.[7] ..... E04C 3/00; E04D 1/36

(52) U.S. Cl. ..... 52/466; 52/544; 52/713; 52/167.1; 52/200; 403/164; 403/150

(58) Field of Search ..... 52/466, 544, 547, 52/713, 167.1, 506.06, 506.05, 508, 537, 500, 18, 91.1; 403/164, 150, 165, 157

(56) References Cited

U.S. PATENT DOCUMENTS

| | | | | | |
|---|---|---|---|---|---|
| 616,617 | A | * | 12/1898 | Hulse | 52/200 |
| 981,813 | A | * | 1/1911 | Stroch | 52/395 |
| 1,119,829 | A | * | 12/1914 | Jeter | 52/464 |
| 1,379,359 | A | * | 5/1921 | Partzschefeld, Jr. | 52/395 |
| 1,773,299 | A | * | 8/1930 | Braeger | 52/200 |
| 1,882,105 | A | | 10/1932 | Wender | |
| 2,073,278 | A | * | 3/1937 | Hohl | 52/461 |
| 2,653,686 | A | * | 9/1953 | Routt | 52/506.08 |
| 3,063,201 | A | * | 11/1962 | Rylander | 52/466 |
| 3,916,589 | A | * | 11/1975 | Richter | 52/81.3 |
| 4,139,974 | A | | 2/1979 | Fox | |
| 4,184,299 | A | | 1/1980 | East | |
| 4,193,247 | A | | 3/1980 | Heckelsberg | |
| 4,361,998 | A | | 12/1982 | Ellison et al. | |
| 4,400,922 | A | | 8/1983 | Boyer | |
| 4,463,534 | A | * | 8/1984 | Crigler | 52/395 |
| 4,495,743 | A | | 1/1985 | Ellison et al. | |
| 4,514,952 | A | | 5/1985 | Johansson | |
| 4,543,760 | A | | 10/1985 | Barker et al. | |
| 4,575,983 | A | | 3/1986 | Lott, Jr. et al. | |
| 4,796,403 | A | | 1/1989 | Fulton et al. | |
| 4,999,951 | A | * | 3/1991 | Keys et al. | 49/478.1 |
| 5,001,882 | A | | 3/1991 | Watkins et al. | |
| 5,181,360 | A | | 1/1993 | Shingler | |
| 5,222,341 | A | | 6/1993 | Watkins et al. | |

(List continued on next page.)

*Primary Examiner*—Carl D. Friedman
*Assistant Examiner*—Nahid Amiri
(74) *Attorney, Agent, or Firm*—Arnold B. Silverman; Eckert Seamans Cherin & Mellott, LLC

(57) ABSTRACT

A panel clip assembly for use with skylight or roof panel systems and having allowance for reduced movement of panels both parallel and perpendicular to the seam formed by adjoining panels, together with improved allowance for rotational and pivotal movement of said panels. The panel clip includes a base member with a base plate and upward extending flanges; an interim mount member movably attached to the upward extending flanges of the base member by a pin assembly; and an upper clip assembly for receiving and constraining the panels. The upper clip member is movably attached to the mount member such that said clip member can slide in a direction parallel to the seam formed by adjoining roof panels. In addition, the mount member is capable of rotational movement in the plane of the panels and pivotal movement about the axis of the pin assembly. The clip assembly of the present invention therefore allows for a range of panel movements in response to forces including thermal expansion, seismic activity, loading on the panels and wind uplift.

21 Claims, 8 Drawing Sheets

U.S. PATENT DOCUMENTS 5,363,624 A 11/1994 Cotter
5,514,952 A 5/1996 Parkinson
5,606,838 A 3/1997 Hughes et al.
5,692,345 A * 12/1997 Mogaki et al. ..... 52/483.1
5,974,752 A * 11/1999 Watson ..... 52/466
5,998,747 A * 12/1999 Kelso et al. ..... 200/331
6,148,565 A * 11/2000 Lancaster ..... 52/13
6,164,024 A 12/2000 Konstantin
6,289,646 B1 * 9/2001 Watanabe ..... 52/506.01
6,354,045 B1 * 3/2002 Boone et al. ..... 52/95
6,588,165 B1 * 7/2003 Wright ..... 52/506.05
2002/0124514 A1 * 9/2002 Higgins

* cited by examiner

PANEL CLIP ASSEMBLY FOR USE WITH SKYLIGHT OR ROOF PANELS

FIELD OF THE INVENTION

The invention relates to a panel clip assembly for use with a skylight or roof panel system and with improved allowances for noise-reduced longitudinal and transverse panel movement in response to thermal expansion and also for rotational and pivotal movement of the panels in response to other forces, including seismic activity.

BACKGROUND OF THE INVENTION

It is well known to secure standing seam roof and wall panels, including translucent such panels, to purlin or girt substrates using hidden clips and related clip assemblies. Examples of various of these clip assemblies are shown in U.S. Pat. Nos. 4, 184,299, 4,193,247, 4,361,998, 4,495,743, 4,543,760, 4,575,983, 5,001,882, 5,181,360, 5,222,341, 5,363,624 and 5,606,838. As noted in this prior art, a continuing problem has existed concerning the impact of thermal forces (expansion and contraction) on panels supported and joined together by clip assemblies. If clip assemblies are too rigid, damage may occur to the panels or clip assemblies during thermal expansion or contraction. In addition, undesirable frictional noises are caused by panel movement resulting from thermal and other forces, i.e., panels rubbing against the clip assembly and/or the substrate.

In response to these concerns, clip assemblies have been designed with two interlocking but moveable pieces. More specifically, it is known to use a clip assembly with a lower base member that is fixed to a substrate and an upper clip member which is attached to the base member in such a manner that the clip member can slide parallel to the seam created by adjoining panel members. See, e.g., U.S. Pat. Nos. 5,514,952 and 4,575,983. This sliding movement helps relieve expansion and contraction forces that run parallel to the panel seam.

Existing clip assemblies continue to experience problems from thermal forces, however. In particular, existing clip assemblies are too rigid in respect to, and do not adequately address, thermal forces that are applied perpendicular to panel seams (and perpendicular to the sliding movement allowed for in the clip assemblies described above). Thus, wear and damage problems from such forces continue to exist. In addition, unwanted frictional noises have not been satisfactorily eliminated or reduced.

Further, there exists a need for an improved clip assembly which satisfactorily allows for and addresses a range of other panel movements, including (i) rotational panel movement in response to loading and other forces or misaligned clip assemblies, and (ii) upward panel movement due to, e.g., wind forces or an uneven substrate surface.

No existing clip assembly addresses the need for an assembly that allows for and addresses these various ranges of movement experienced by panels and that also eliminates or reduces corresponding frictional noises. It is therefore an object of the present invention, as detailed in the drawings and corresponding description set forth below, to address these needs. In particular, it is an object of the present invention to allow for rotational panel movement in the horizontal plane of the panel and also for pivotal or rotational movement of the panels about the axis of the mount member that is transverse to the seam formed by adjoining panels. It is a further object of the present invention to allow for panel movement, also in the plane of the panel, that is perpendicular or transverse to the seam formed by adjoining panels and, typically, arises from thermal expansion or contraction. It is also an object of the present invention to reduce wear and noise resulting from frictional movement of roof panels against a substrate or clip assembly. It is an additional object of the present invention to allow for lateral and twisting panel movement in response to seismic activity, such as an earthquake

SUMMARY OF THE INVENTION

The present invention is an improved clip assembly for securing standing seam skylight or roofing panels to a substrate and that allows for a full range of movements by the panels while eliminating or reducing frictional noises. The clip assembly consists of (a) a fixed base member attached to the substrate; (b) an interim rotational mount member that attaches to the base member through use of a pin assembly (e.g., a nut and bolt) in such a manner that the mount member and corresponding panels can rotate horizontally in the plane of the panels and also pivot about the axis of the pin assembly; and (c) an upper clip member which slidably attaches to the rotational mount member and that engages the skylight or roof sheets. In particular, the pin assembly passes through horizontal slots or oblong holes in the mount member.

Thus, the pin assembly can slide horizontally within these slots or oblong holes and the mount member and the upper clip member slidably attached thereto can rotate in the horizontal plane of the panels. This rotational movement compensates for conditions where the clip installer may not place the clip assembly parallel to the standing seams or in the case of rotational/twisting loading forces on the panels. In addition, the pin assembly used to attach the base member to the mount member has an outside diameter that is less than the lesser (minor) inside diameter (i.e., the vertical diameter) of the corresponding horizontal slot or oblong hole within the mount member. As a result, the pin assembly also acts as a hinge, allowing the mount member to pivot about the axis of the pin assembly. In connection with thermal forces, the upper clip member is fixed in the seam between panel(s) while the lower base member is fixed to the substrate and the upper clip and interim mount members are capable of being slidably engaged to one another. Finally, the interim mount member of the clip assembly can slide within the base member and along the pin assembly, thus compensating for structural or thermal movement in the direction perpendicular to the seam. As such, the clip assembly of the present invention offers great strength while allowing panel alignment and movement in a range of movements and direction not provided for in prior art. In addition to addressing thermal expansion, the range of panel movements provided by the present invention also addresses forces and movements caused by seismic activity, i.e., the present invention allows for lateral and twisting panel movements that result from earthquakes or other shifting of the earth's surface.

In a preferred embodiment, clip and base members can be of variable lengths, with longer lengths being used in cases where increased strength is desired. The upper clip member, like the lower base member, may be short in length (for example, 1½ inches) or may be continuous for the length of the skylight or roofing panels (for example, 20 feet).

Addressing noise and friction reduction, skylight or roof panels in the present invention are elevated above the substrate, thus reducing the possibility of rubbing on the substrate (which may cause wear or noise). In addition, the fasteners (such as screws) that are used to hold the clip assembly to the substrate are located at recessed portions of the base member, thus eliminating the possibility of rubbing or friction between the bottoms of the panels and the tops of the fasteners. Further, elastomeric cushioning inserts can be attached to either the base member or the mount member for the purpose of cushioning the skylight or roofing panels where they make contact with the base member. These inserts, too, are intended to reduce wear and noise. Preferably, the upper clip member is made of steel (either stainless or plated carbon steel), and the lower mount member is made of extruded aluminum or steel, such that the intersecting movement between them will be of relatively low friction, allowing free movement and further reducing the possibility of noise.

In an alternative embodiment, where conditions do not require an allowance for rotational and pivotal adjustments, the interim mount can be removed and the upper clip member can attach directly to a base member in a sliding manner. In this embodiment, elastomeric cushioning inserts can again be used. Further, the fasteners which fasten the base member to the substrate are recessed into the base member, thus eliminating the possibility of the skylight or roofing panels rubbing against these fasteners.

In all embodiments, the upper clip member includes upper flanges and lower flanges which act to limit movement of the roof panels in response to upward forces such as wind up-lift.

The clip assembly of the present invention may also be used with wall panel systems.

Other objects and features of the invention, both as to construction and its method of operation, together with additional objects and advantages thereof, will become apparent and best understood from review of the following description of the preferred embodiment in conjunction with the accompanying drawings.

DETAILED DESCRIPTION OF THE PREFERRED EMBODIMENT

Figure 1:
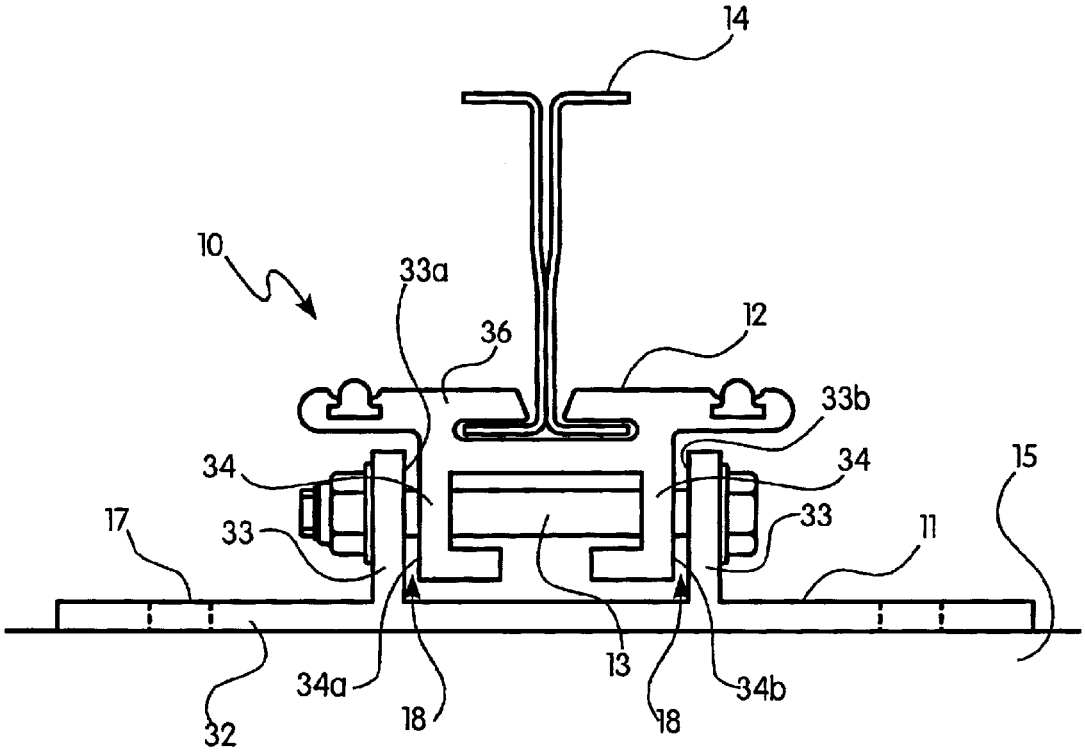
FIG. 1 shows an end view of a preferred embodiment of the clip assembly of the present invention.

FIGS. 1–6 show a clip assembly 10 in accordance with the present invention that is adaptable for use with existing skylight or roof panel systems. Clip assembly 10 can also be used with wall panel systems. Clip assembly 10 includes a base member 11 and an interim rotational mount member 12 that attaches to the base member through use of pin member 13. Clip assembly 10 further comprises an upper clip member 14 that slidably attaches to mount member 12.

Figure 4:
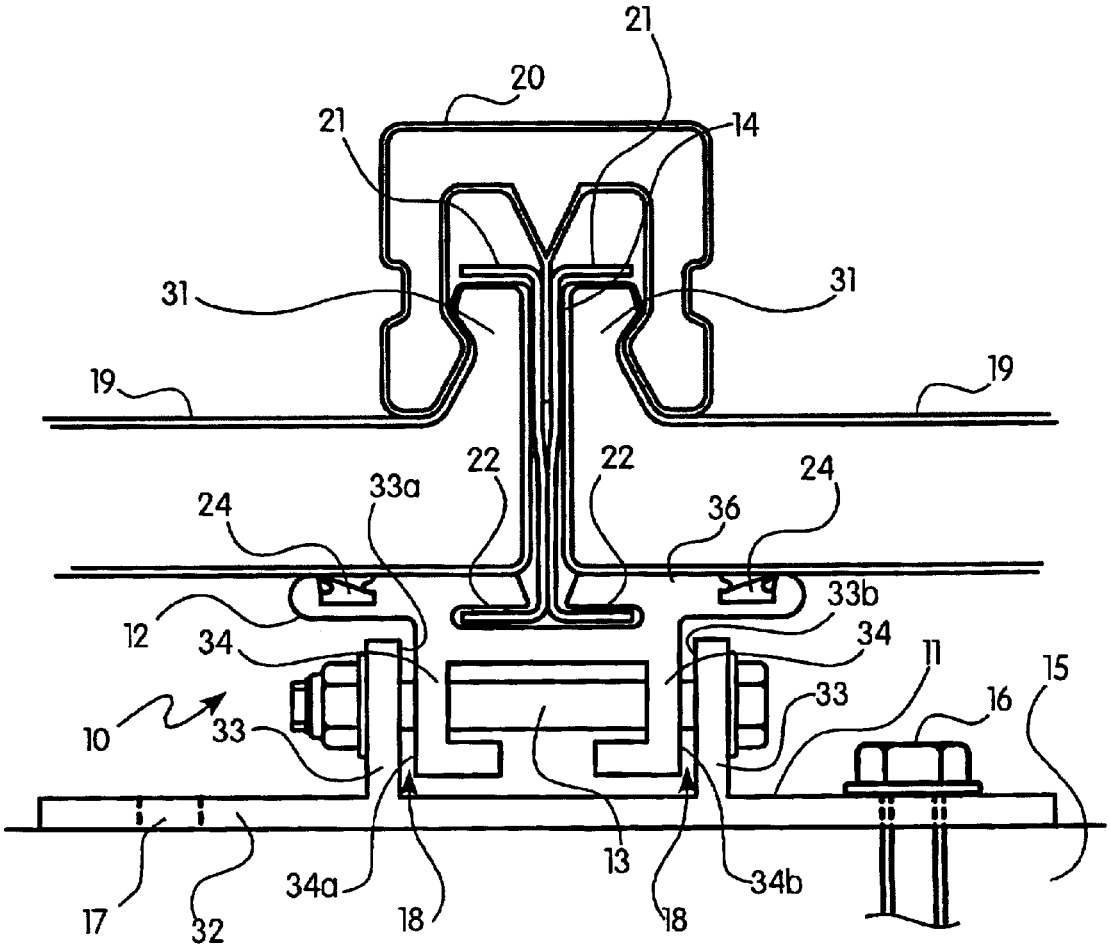
FIG. 4 shows an end view of the clip assembly depicted in FIG. 2, together with the related substrate end panels with which the clip assembly interacts, to enable limited movement of clip members and of the panels in a multiplicity of different directions.
Figure 7:
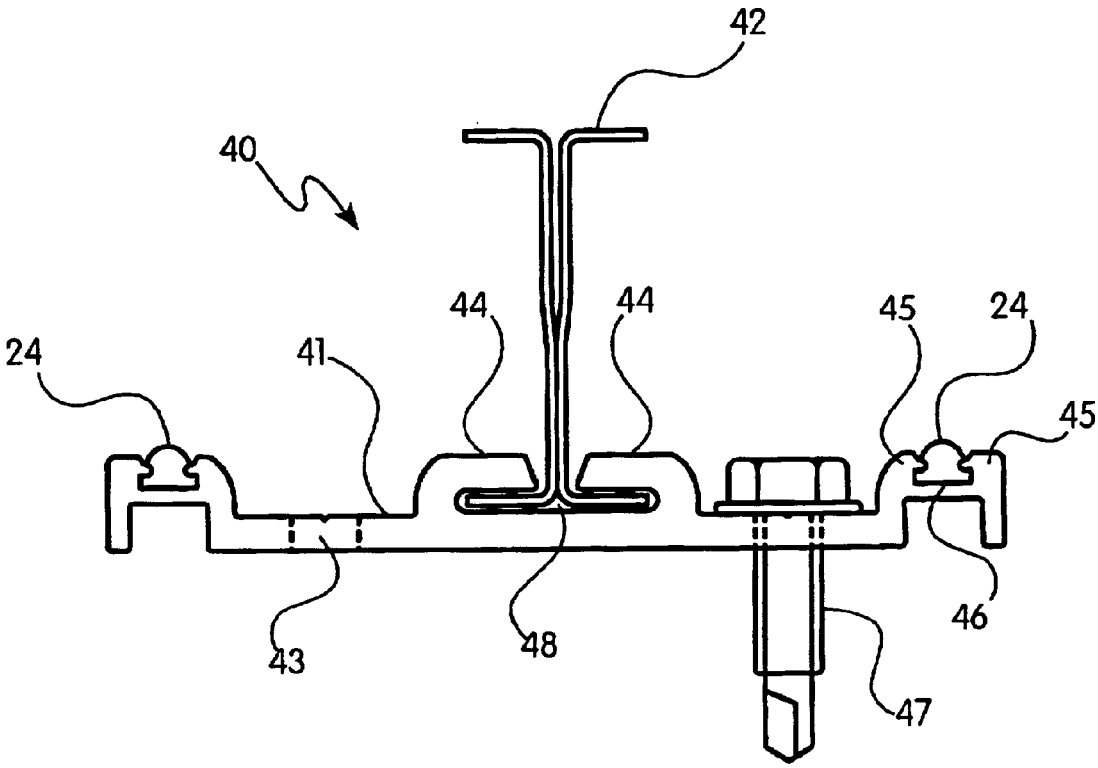
FIG. 7 shows an alternative embodiment of the clip assembly of the present invention.

In use, and referring in particular to FIGS. 1 and 4, base member 11 is attached to a substrate 15 by fasteners 16 which pass through holes 17 in base plate 32 of base member 11. Preferably, and as shown in FIG. 7, holes 17 are located in base plate 32 (preferably with recessed upper portions) so that the top of fasteners 16 lie below the bottom surface of panels 19. Fasteners 16 can be screws, nut and bolt fasteners or other commonly used fasteners for clip assemblies. Panels 19 are joined and constrained, at their respective edges, through contract with upper clip member 14 and use of a snap-cap 20 that snap-fits over flanges 31 of panels 19. Suitable panels 19 and related systems (including snap-caps 20) for use in connection with clip assembly 10 include panels and panel systems manufactured by, for example, Politec, Inc. of Switzerland. Other panels and structural panel systems may also be used. Panels 19 are typically one foot to two feet in width, but can be of greater widths and varying sizes and forms, all of which can be used within the purview of this invention.

The novel aspects of the present invention are revealed, in part, by a closer examination of the connection between base member 11 and mount member 12. Referring to FIGS. 1, 2A, 3, 4 and 6, mount member 12 is joined to base member 11 by pin 13. Preferably, pin 13 is a bolt and nut assembly that passes through horizontally oblong holes or slots 35 in flanges 34 of mount member 12. In addition, pins 13 have outside diameters which are less than the lesser (minor) inside diameter (i.e., the vertical diameter) of horizontally oblong holes or slots 35.

Pin 13 passes through and is rigidly fixed to upper flanges 33 of base member 11. Mount member 12 has downwardly extending flanges 34 which are positioned between upper flanges 33. Oblong holes 35 are located within flanges 34 and, as described above, pin 13 passes through oblong holes 35. The width between the outer sides 34*a* and 34*b* of flanges 34 is less than the width between the inner sides 33*a* and 33*b* of flanges 33, creating gaps 18 between flanges 33 and 34.

This configuration and means of attaching mount member 12 to base member 11 allows mount member 12, upper clip member 14 and corresponding panels 19 to rotate horizontally in the plane of the panels and also to pivot at pin 13.

Figure 2:
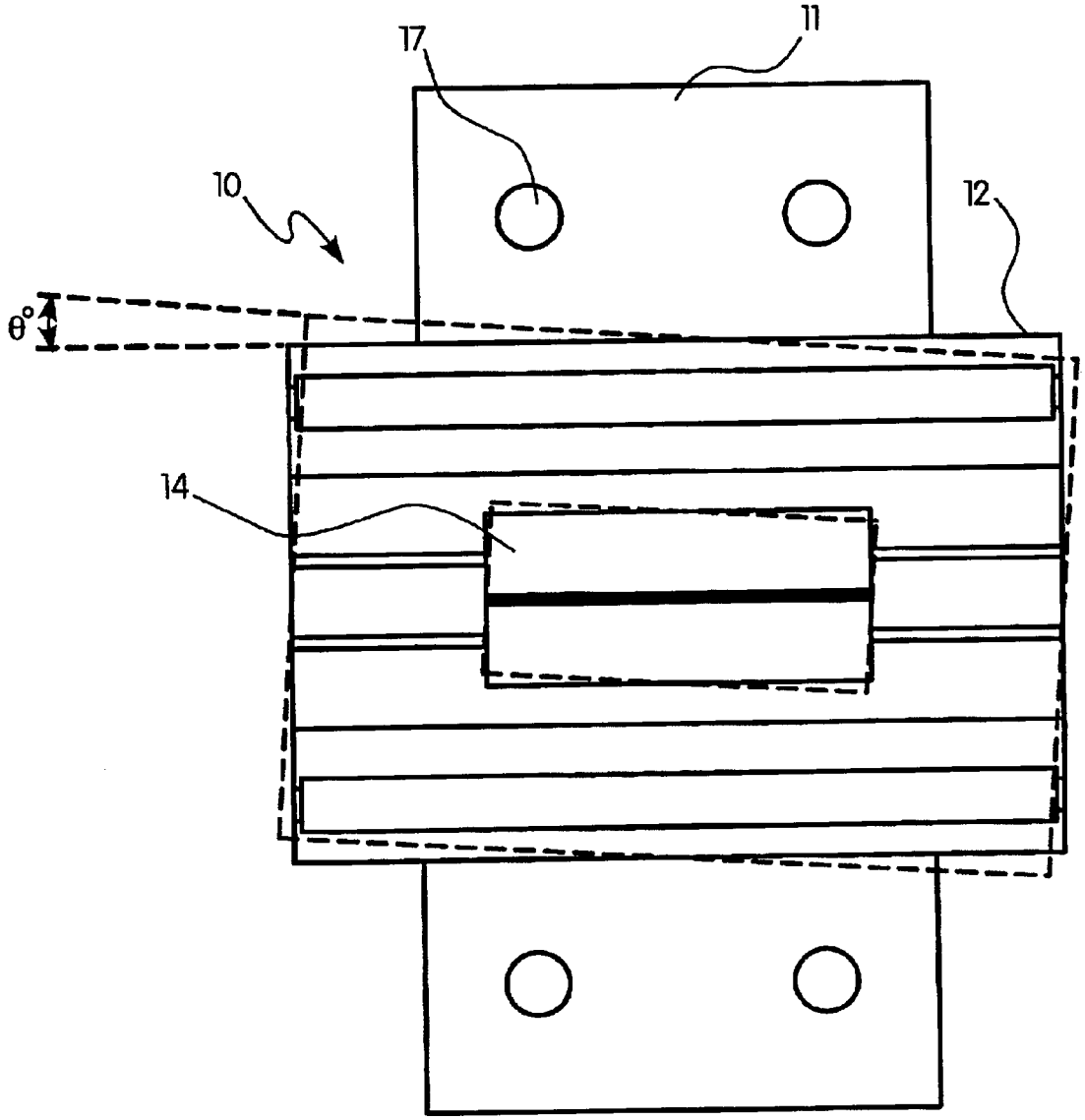
FIG. 2 shows a top view of a preferred embodiment of the clip assembly of the present invention.
Figure 2A:
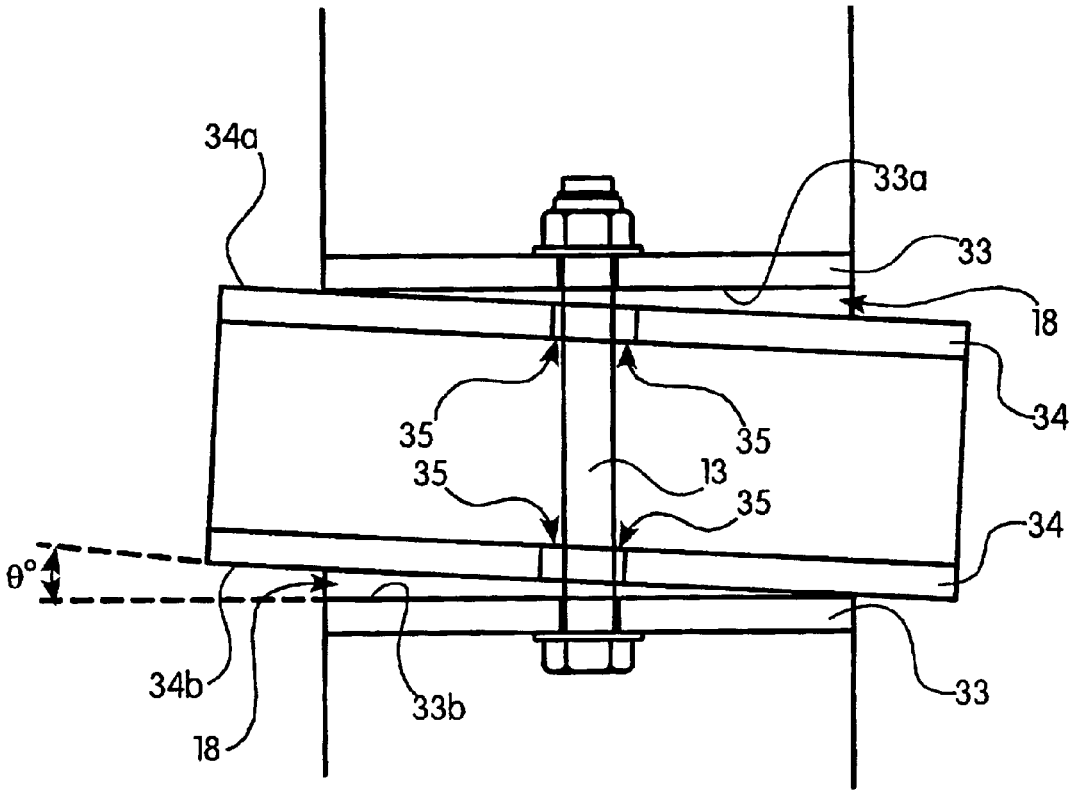
FIG. 2A shows a top view of a portion of the clip assembly depicted in FIG. 2, together with an alternate position of the upper portion of the assembly as permitted by the rotational mount member.
Figure 3:
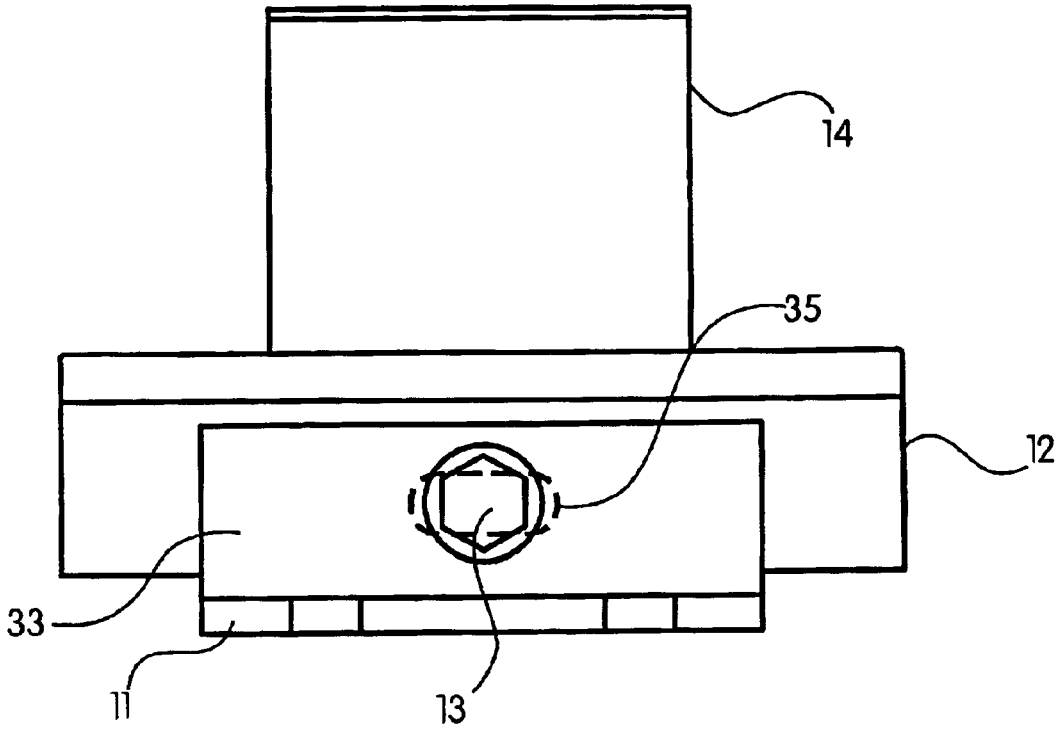
FIG. 3 shows a side view of the clip assembly depicted in FIG. 2.

More specifically, and referring to FIGS. 2, 2A and 4, the clip assembly of the present invention, in a preferred embodiment, permits an approximate 4 degrees horizontal rotation of mount member 12 and clip member 14 relative to base member 11, all in the horizontal plane of panels 19. This angle of rotation is shown as angle β in FIG. 2A; a rotated position of β degrees is shown for mount member 12 and clip member 14 with dotted lines in FIG. 2. This horizontal rotational ability will compensate for rotational loading forces on the panels, twisting caused by seismic activity and also for instances where a clip installer does not place the clip perfectly in parallel alignment with the seam of the roof/skylight panels when fastening the clip assembly to the substrate. Horizontal rotation in the range of 4 degrees can be achieved by using a clip assembly gap 18 of approximately ⅛ inch, a pin 13 with a diameter of approximately 3⁄16 inches and oblong holes 35 with an inner (minor) vertical diameter of about ¼ inches and an inner (major) horizontal diameter of about ⅜ inch. Other variations in these dimensions are possible and can be used to obtain the novel results of the present invention.

Figure 5:
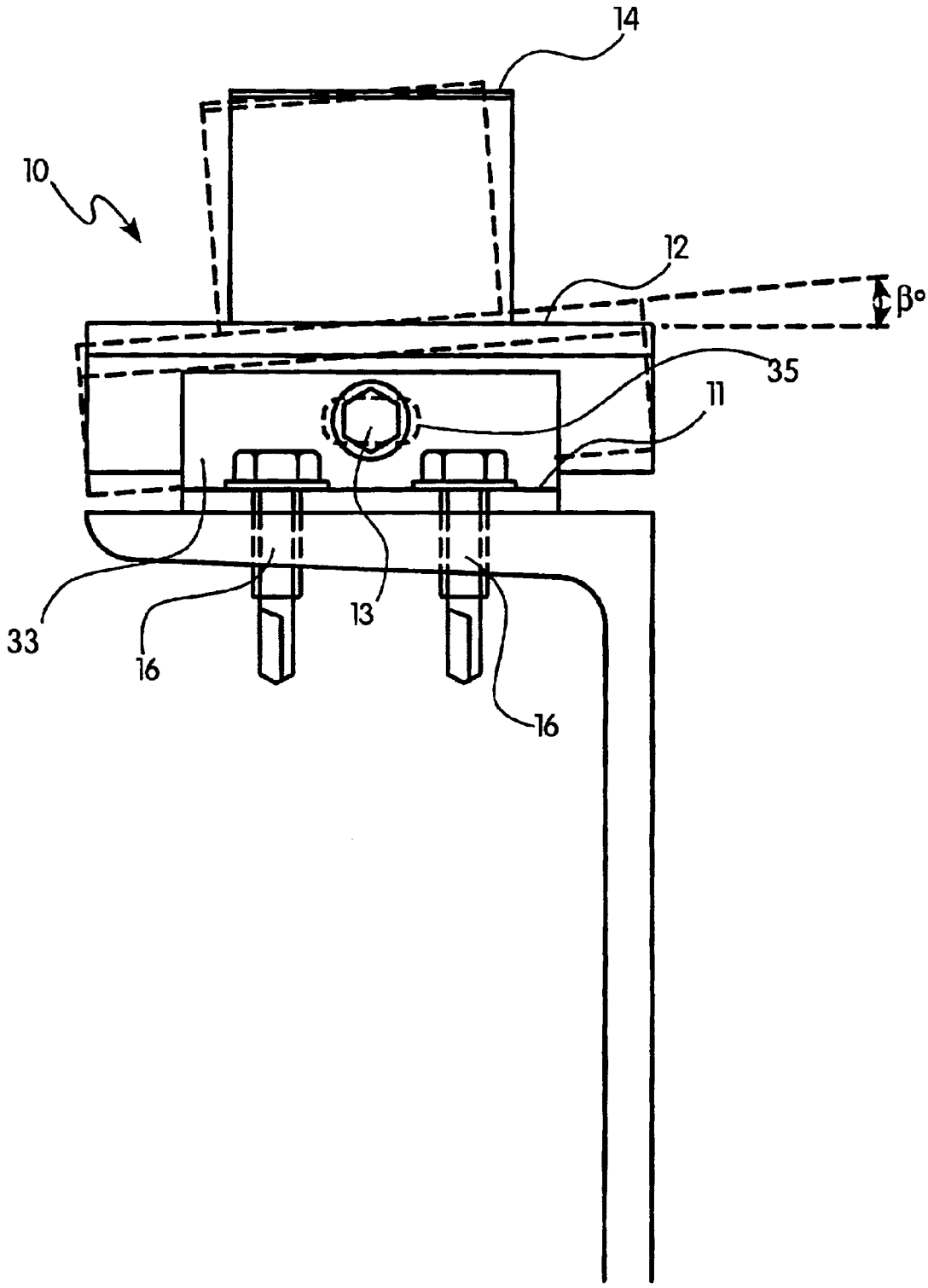
FIG. 5 shows a side view of the clip assembly depicted in FIG. 2, together with an alternate position of the upper portion of the assembly as permitted by the rotational mount member.

Similarly, and referring to FIG. 5, mount member 12 and clip member 14 can pivot or rotate at pin 13. More specifically, and as shown by the dotted lines and angle θ in FIG. 5, mount member 12 and clip member 14 can rotate by approximately 5 degrees, in either direction about the axis of pin 13, from their respective normal positions. This rotation allows clip assembly 10 to adapt to a substrate surface which is uneven or not planar with the plane of the panels 19. This rotation also allows clip assembly to respond better to (and avoid damage resulting from) vertical forces, such as wind or load-bearing forces as well as seismic related movement and also assures that clip member 14 is free to move within mount member 12.

The present invention further addresses thermal contraction and expansion forces, as well as movement caused by seismic activity, through gap 18. More specifically, in the course of assembling roof or skylight panels, it is desirable that the upper portion of a clip assembly (that which contacts the panels)—clip member 14 in the present invention—has the ability to move in a direction perpendicular to the panel seam. In present clip assembly 10, this perpendicular panel movement is permitted by gap 18. Gap 18, which in a preferred embodiment is approximately ⅛ inch, accommodates perpendicular thermal movement of the panels and also will compensate for conditions where panels may be slightly wider or narrower than their nominal sizes or where field adjustment is necessary. Again, the width of gap 18 can vary to obtain the same purpose.

Figure 6:
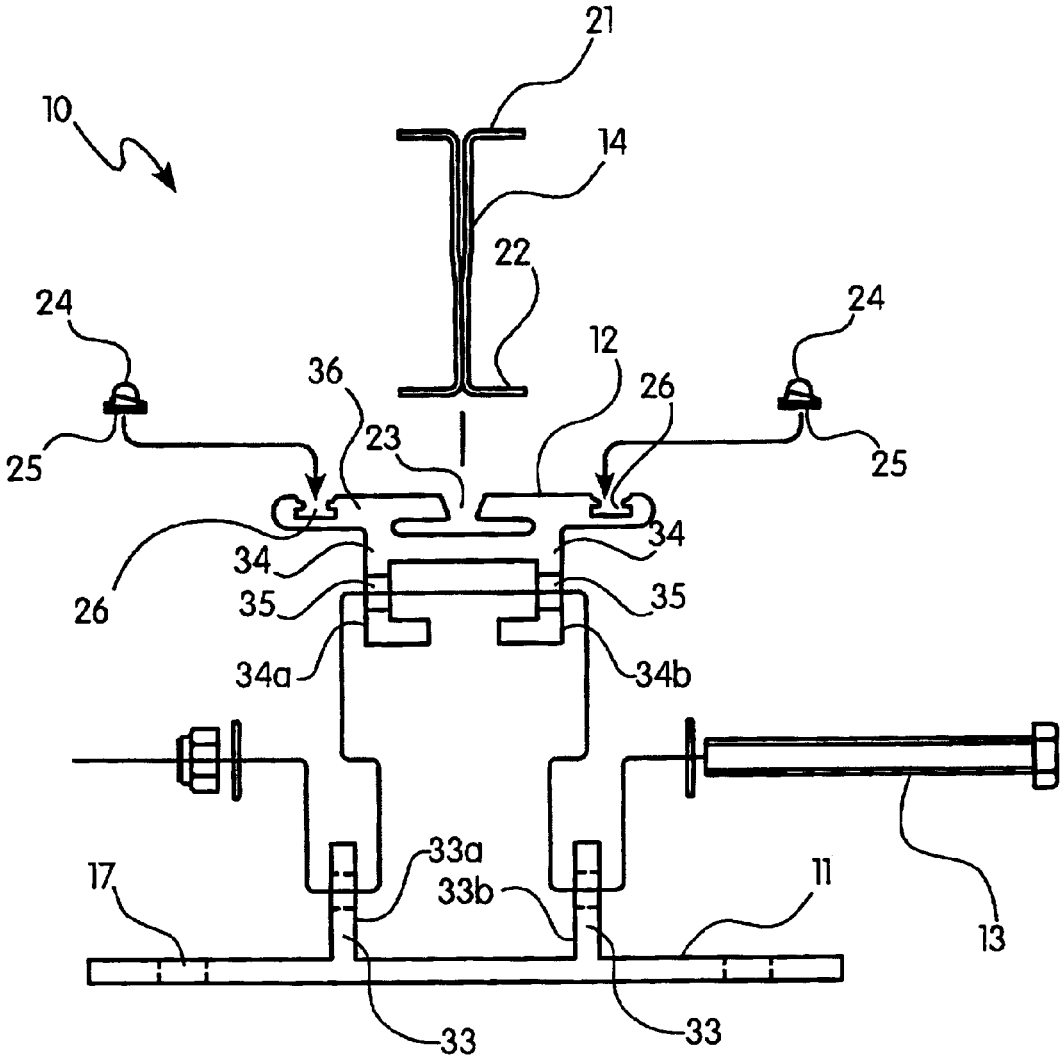
FIG. 6 shows an exploded end view of the clip assembly depicted in FIG. 2.

Finally, in connection with the ability of the present invention to allow for a full range of panel movements, upper clip member 14 slides within mount member 12. As shown in FIGS. 1, 4 and 6, element 14 is, in a preferred embodiment, an "I" shaped element consisting of two pieces of sheet metal, each of which is essentially channel-shaped and both of which are joined by welding or other means to form the "I" shape. In a preferred embodiment, clip member 14 is comprised of stainless steel, and is approximately 0.040 inches thick.

Bottom flanges 22 of clip member 14, as shown in FIG. 6, engage cavities 23 of mount member 12. This engagement is sufficiently lose, preferably with a clearance of at least 0.010" on any side of contact, such that clip member 14 is free to slide longitudinally within element mount member 12 and parallel to the corresponding panel seams. Thus, clip member 14 can remain fixed to adjoining panels 19, while able to slide within mount member 12 in response to thermal expansion or contraction forces experienced by the roof or skylight panels 19. Cavities 23 are preferably comprised of steel or aluminum that has been treated for hardness, such that sliding movement of clip member 14 within cavities 23 is with relatively low friction.

Clip member 14 also includes top flanges 21 that act to limit upward movement of typical roof or skylight panels 19, caused typically by wind up-lift, as shown in FIG. 4. FIG. 4 depicts the space provided between the bottom surface of too flange 21 of the upper clip member, as spaced from the adjacent too surface of flange 31 of panel 19. thereby enabling limited movement of the too surface of flange 31 toward, or away from, the bottom surface of upper clip member top flange 21, when the panel 19 is subjected to displacing forces caused by wind load or mechanical loading on the system. In FIG. 4, snap-cap 20 is also shown in a typical position where it acts to hold together the two adjoining upward flanges 31 of the roof or skylight panels 19.

For common applications, clip member 14 is preferably about 1½ inches long. However, for certain high-strength applications, clip member 14 can be much longer, perhaps as much as 20 feet. When clip member 14 of clip assembly 10 is of a greater length, clip assembly 10 not only allows for unlimited amounts of movement, but also acts to reinforce the roofing or skylight panel 19 to thus increase the strength of said panels.

The clip assembly of the present invention contributes further beneficial properties in respect to the reduction of friction and resulting wear and noise associated with panel movement. In the first instance, and referring to FIGS. 1, 4 and 6, panels 19 rest on an upper base plate 36 of mount member 12. Thus, panels 19 are elevated above the substrate and therefore do not experience any wear or friction from movement against the substrate. In addition, base plate 36 contains dual cavities 26 that receive and hold elastomeric inserts 24. Downward pressure on the roof or skylight panels 19 will cause panels 19 to make contact with and bear against elastomeric inserts 24, which provide a cushioning effect in response to such pressure or force. Further, the top surface of elastomeric inserts 24 is coated with a low-friction coating (such as Teflon), thus allowing roof or skylight panels 19, when undergoing thermal movement, to slide upon inserts 24 with relatively little friction. This arrangement allows for the free movement of the roof/skylight sheets when subjected to thermal expansion or contraction and also tends to reduce the noise caused by sliding of roof or skylight panels 19. In a preferred embodiment, inserts 24 have a double flanged base 25 which slides and is glued into cavities 26.

FIG. 7 illustrates another alternative clip assembly embodiment 40 of the present invention which utilizes the friction and noise reducing benefits of inserts 24 without a mount member 12. Clip assembly 40 has particular application in cases where it is known with certainty that the substrate and field conditions are such that only the sliding movement of clip member within a base element is required. Clip assembly 40 is comprised of a base member 41 and clip member 42. Clip member 42 is identical to clip member 14 described above. Base member 41 is rigidly attached to a substrate by a fasteners 47. To reduce friction and wear, fasteners 47 attaches through recessed holes 43 in base member 41 such that the tops of fasteners 47 do not come in contact with supported panels. Base member 41 contains upper receiving flanges 44 that forms a cavity 48 that receives and allows clip member 42 to slide parallel to the seam formed by adjoining panels. Base member 41 also contains flanges 45, each with a cavity 46 that receives and holds elastomeric inserts 24. Inserts 24 work in the same manner as described above. Again, clip member 41 is preferably comprised of steel and flanges 44, along with base member 41 are comprised of aluminum or steel to reduce friction.

What is claimed is:

1. A clip assembly for use with skylight or roof panels systems and having allowance for noise-reduced horizontal movement of panels both parallel and perpendicular to the seam formed by adjoining panels, together with allowance for rotational and pivotal movement of said panels, said clip assembly comprising:

a. a base member with a base plate and upward extending flanges;

b. an interim mount member movably attached to said upward extending flanges of said base member by a pin assembly, with said mount member capable of rotational movement in the plane of said panels and pivotal movement about the axis of the pin assembly; and c. an upper clip member for receiving and constraining said panels, said upper clip member movably attached to said mount member such that said clip member can slide in a direction parallel to the seam formed by adjoining roof panels.

2. A clip assembly in accordance with claim 1, wherein said interim mount member is comprised of downwardly extending flanges, each said flange having horizontally oblong holes therein through which said pin assembly passes.

3. A clip assembly in accordance with claim 1, wherein said pin assembly has a diameter which is less than the lesser vertical diameter of said oblong holes.

4. A clip assembly in accordance with claim 1, wherein said interim mount member and said upper clip member can slide on said pin assembly and thereby allow for panel movement in a direction perpendicular to the seam formed between adjoining roof panels.

5. A clip assembly in accordance with claim 1, wherein said clip member is an "I" shaped element comprised of two channel-shaped pieces of sheet metal fastened together to form top and bottom flanges extending outward from the center of said upper clip member, said top flanges acting to limit upward movement of the panels, and said bottom flanges positioned within a receiving cavity in said interim mount member to allow for sliding movement of said upper clip member in respect to said interim mount member.

6. A clip assembly in accordance with claim 1, wherein said interim mount member further comprises elastomeric inserts at the top of said interim mount member, said inserts acting to cushion the impact of said roof panels on said clip assembly when downward pressure is exerted on said panels.

7. A clip assembly in accordance with claim 6, wherein said elastomeric inserts have a low-friction coating on the upper surface of said inserts.

8. A clip assembly in accordance with claim 1, wherein said upper clip member is comprised of stainless steel and said interim mount member is comprised of a metal from the group consisting of steel and aluminum.

9. A clip assembly for use with skylight or roof panels systems and having allowance for noise-reduced horizontal movement of panels parallel to the seam formed by adjoining panels, said clip assembly comprising:

a. a base member that includes elastomeric inserts at the top of said base member, said inserts acting to cushion the impact of said roof panels on said clip assembly when downward pressure is exerted on said panels; and b. an upper clip member for receiving and constraining said roofing panels, said upper clip member movably attached to said base member such that said upper clip member can slide in a direction parallel to the seam formed by adjoining roof panels.

10. A clip assembly in accordance with claim 9, wherein said elastomeric inserts have a low-friction coating on the upper surface of said inserts.

11. A clip assembly in accordance with claim 9, wherein said upper clip member is comprised of stainless steel and said base member is comprised of a metal from the group consisting of steel and aluminum.

12. A clip assembly in accordance with claim 1, wherein said base member includes holes and wherein said clip assembly further includes fasteners positioned in said holes to mount said base member to a substrate, wherein said fasteners have tons lying below said panels.

13. A clip assembly in accordance with claim 9, wherein said base member includes holes and wherein said clip assembly further includes fasteners positioned in said holes to mount said base member to a substrate, wherein said fasteners have tops lying below said panels.

14. A clip assembly in accordance with claim 12, wherein said holes have recessed upper portions such that the tops of said fasteners lie below the surface of said base member.

15. A clip assembly in accordance with claim 13, wherein said holes have recessed upper portions such that the tops of said fasteners lie below the surface of said base member.

16. A clip assembly in accordance with claim 1, wherein said clip assembly is used with wall panel systems.

17. A clip assembly in accordance with claim 9, wherein said clip assembly is used with wall panel systems.

18. A clip assembly in accordance with claim 1, wherein the use of said clip assembly in a panels system allows for horizontal, rotational and pivotal panels movements in response to forces caused by thermal expansion, seismic activity, loading on the panels or wind uplift.

19. A clip assembly in accordance with claim 4, wherein the use of said clip assembly in a panels system allows for horizontal, rotational and pivotal panels movements in response to forces caused by thermal expansion, seismic activity, loading on the panels or wind uplift.

20. A clip assembly in accordance with claim 1, wherein said upper clip member is an "I"-shaped element comprised of two channel-shaped pieces fastened together to form top and bottom flanges extending outwardly from the center of said upper clip member, said top and bottom flanges being separated by a distance sufficient to provide a space between the bottom surface of said upper clip member top flange and the panel surface adjacent said upper clip member top flange to allow for limited movement between said flange surfaces.

21. A clip assembly in accordance with claim 9, wherein said upper clip member is an "I"-shaped element comprised of two channel-shaped pieces fastened together to form top and bottom flanges extending outwardly from the center of said upper clip member, said top and bottom flanges being separated by a distance sufficient to provide a space between the bottom surface of said upper clip member top flange and the panel surface adjacent said upper clip member top flange to allow for limited movement between said flange surfaces.

* * * * *

UNITED STATES PATENT AND TRADEMARK OFFICE

CERTIFICATE OF CORRECTION

PATENT NO. : 6,845,592 B2
DATED : January 25, 2005
INVENTOR(S) : William P. Voegele It is certified that error appears in the above-identified patent and that said Letters Patent is hereby corrected as shown below:

Column 5,
Lines 58-60, every instance where "too" appears, insert -- top --.

Column 7,
Lines 3 and 20, after "said", insert -- upper --.

Column 8,
Line 9, "tons" should read -- tops --.

Signed and Sealed this

Third Day of May, 2005

JON W. DUDAS
*Director of the United States Patent and Trademark Office*